US006477996B2

(12) United States Patent
Ogawa

(10) Patent No.: US 6,477,996 B2
(45) Date of Patent: Nov. 12, 2002

(54) VARIABLE VALVE TIMING SYSTEM

(75) Inventor: Kazumi Ogawa, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/879,961

(22) Filed: Jun. 14, 2001

(65) Prior Publication Data

US 2002/0017255 A1 Feb. 14, 2002

(30) Foreign Application Priority Data

Jun. 14, 2000 (JP) ..... 2000-179055

(51) Int. Cl.[7] ..... F01L 1/34

(52) U.S. Cl. ..... 123/90.15; 123/90.12; 123/90.17; 123/90.31; 74/567; 74/568 R; 464/1; 464/2; 464/160

(58) Field of Search ..... 123/90.15, 90.12, 123/90.17, 90.31; 464/1, 2, 160; 74/567, 568 R

(56) References Cited

U.S. PATENT DOCUMENTS 5,218,935 A * 6/1993 Quinn, Jr. et al. ..... 123/90.17
5,520,145 A * 5/1996 Nagai et al. ..... 123/90.17
5,737,056 A * 4/1998 Mikame et al. ..... 123/90.17
5,957,098 A * 9/1999 Fukuhara et al. ..... 123/90.17
6,058,897 A * 5/2000 Nakayoshi ..... 123/90.17
6,105,543 A * 8/2000 Ogawa ..... 123/90.17
6,247,434 B1 * 6/2001 Simpson et al. ..... 123/90.17

FOREIGN PATENT DOCUMENTS

JP 9-324613 A 12/1997

OTHER PUBLICATIONS

US 5,816,206, 10/1998, Moriya (withdrawn)*

* cited by examiner

*Primary Examiner*—Thomas Denion
*Assistant Examiner*—Ching Chang
(74) *Attorney, Agent, or Firm*—Burns, Doane, Swecker & Mathis, LLP

(57) ABSTRACT

A variable valve timing system is provided with a relative rotation controlling mechanism allowing relative rotation of the housing member and the rotor member by an unlock operation through the supply of operation fluid, and restricting the relative rotation of the housing member and the rotor member at an intermediate angle phase between a most retarded angle phase and a most advanced angle phase by a lock operation through the discharge of the operation fluid. A hydraulic pressure circuit controls the supply and discharge of the operation fluid to the relative rotation controlling mechanism and also controls the supply and discharge of the operation fluid to the advanced angle chamber and the retarded angle chamber. The hydraulic pressure circuit is adapted to discharge the operation fluid from the advanced angle chamber, the retarded angle chamber and the relative rotation controlling mechanism when the combustion engine is started.

9 Claims, 12 Drawing Sheets

VARIABLE VALVE TIMING SYSTEM

This application is based on and claims under 35 U. S. C. §119 with respect to Japanese Application No. 2000-179055 filed on Jun. 14, 2000, the entire content of which is incorporated herein by reference.

FIELD OF THE INVENTION

This invention generally relates to variable valve timing systems. More particularly, the present invention pertains to a variable valve timing system for controlling the opening and closing time of an intake valve and an exhaust valve of a vehicle engine.

BACKGROUND OF THE INVENTION

A known variable valve timing system is described in Japanese Patent Laid-Open Publication H09-324613. The disclosed variable valve timing system includes a housing member disposed in the driving force transmitting system for transmitting the driving force from the crankshaft of the combustion engine to the camshaft to control the opening and closing of either one of the intake valve and the exhaust valve of the combustion engine. The housing member rotates as a unit with either one of the crankshaft or the camshaft.

The variable valve timing system also includes a rotor member rotatably assembled on a shoe portion provided on the housing member. The rotor member forms an advanced angle chamber and a retarded angle chamber at a vane portion in the housing member and integrally rotates with either one of the camshaft or the crankshaft. The variable valve timing system further includes a relative rotation controlling mechanism. The relative rotation controlling mechanism allows relative rotation of the housing member and the rotor member through an unlock operation by the supply of an operation fluid. The relative rotation controlling mechanism restricts the relative rotation of the housing member and the rotor member at an intermediate angle phase between the most retarded angle phase and the most advanced angle phase through the lock operation by the discharge of the operation fluid.

The variable valve timing system still further includes a hydraulic pressure circuit for controlling the supply and discharge of the operation fluid to the relative rotation controlling mechanism as well as for controlling the supply and discharge of the operation fluid to the advanced angle chamber and the retarded angle chamber.

In this known variable valve timing system, the relative rotation controlling mechanism restricts the relative rotation of the housing member and the rotor member at the intermediate angle phase between the most retarded angle phase and the most advanced angle phase. Under this condition, the opening and closing time of either one of the intake valve and the exhaust valve is set in order to obtain a good starting performance of the combustion engine. Accordingly, when the combustion engine is started, if the relative rotation of the housing member and the rotor member is not restricted by the relative rotation controlling mechanism at the intermediate angle phase between the most retarded angle phase and the most advanced angle phase, the starting performance of the combustion engine might be adversely affected.

The restriction of the relative rotation of the housing member and the rotor member by the relative rotation controlling mechanism at the intermediate angle phase when the combustion engine is started may be interrupted by the design of the hydraulic pressure circuit, and by a remaining operation fluid in the advanced angle chamber, the retarded angle chamber, and the relative rotation controlling mechanism. In the known hydraulic pressure circuit, when a controlling valve provided in the hydraulic pressure circuit is de-energized, the operation fluid is set to be supplied to the advanced angle chamber or the retarded angle chamber. In the known hydraulic pressure circuit, when the combustion engine is started, if the controlling valve is de-energized, the operation fluid is supplied to the advanced angle chamber or the retarded angle chamber. Then the rotor member might not rotate relative to the housing member at the intermediate angle phase.

A need thus exists for a variable valve timing system in which a hydraulic pressure circuit controls the supply and discharge of an operation fluid to a relative rotation controlling mechanism and controls the supply and discharge of the operation fluid to an advanced angle chamber and a retarded angle chamber.

SUMMARY OF THE INVENTION

The present invention provides a variable valve timing system including a hydraulic pressure circuit for controlling the supply and system discharge of an operation fluid to a relative rotation controlling mechanism while also controlling the supply and discharge of the operation fluid to an advanced angle chamber and a retarded angle chamber. The hydraulic pressure circuit is adapted to discharge the operation fluid from the advanced angle chamber, the retarded angle chamber and the relative rotation controlling mechanism when the combustion engine is started.

The present invention also provides a variable valve timing system including the hydraulic pressure circuit for controlling the supply and discharge of the operation fluid to the relative rotation controlling mechanism while also controlling the supply and discharge of the operation fluid to the advanced angle chamber and the retarded angle chamber. The hydraulic pressure circuit is adapted to discharge the operation fluid from the advanced angle chamber, the retarded angle chamber and the relative rotation controlling mechanism when the supply and discharge control of the operation fluid is defective.

When used in a variable valve timing system for an automobile, the operation fluid is desirably discharged from the advanced angle chamber, the retarded angle chamber and the relative rotation controlling mechanism by a single controlling valve provided in the hydraulic pressure circuit. Alternatively the operation fluid is desirably discharged from the advanced angle chamber, the retarded angle chamber and the relative rotation controlling mechanism by a plurality of controlling valves provided in the hydraulic pressure circuit.

According to the present invention as noted above, the hydraulic pressure circuit is adapted to discharge the operation fluid from the advanced angle chamber, the retarded angle chamber and the relative rotation controlling mechanism when the combustion engine is started. Accordingly, when the combustion engine is started, operation fluid remaining in each of the advanced angle chamber and the retarded angle chamber can be discharged. The relative rotation of the housing member and the rotor member is thus not interrupted by the operation fluid, and the rotor member can rotate quickly relative to the housing member to the intermediate phase position between the most advanced angle phase position and the most retarded angle phase position by the torque variation from the driving force transmitting system. When the combustion engine is started, the operation fluid can be discharged from the relative rotation controlling mechanism and so the appropriate lock operation can be obtained by the relative rotation controlling mechanism. The relative rotation of the housing member and the rotor member is appropriately restricted at the intermediate phase position. Accordingly, the starting performance of the combustion engine can be improved.

Also in accordance with the present invention as noted above, the hydraulic pressure circuit is adapted to discharge the operation fluid from the advanced angle chamber, the retarded angle chamber and the relative rotation controlling mechanism when the combustion engine is actuated and when the supply and discharge control of the operation fluid is defective. Accordingly, when the supply and discharge controlling of the operation fluid is defective, the operation fluid remaining in each of the advanced angle chamber and the retarded angle chamber can be discharged. The relative rotation of the housing member and the rotor member is thus not interrupted by the operation fluid, and the rotor member can rotate quickly relative to the housing member to the intermediate phase position between the most advanced angle phase position and the most retarded angle phase position by the torque variation from the driving force transmitting system. When the supply and discharge control of the operation fluid is defective, the operation fluid can be discharged from the relative rotation controlling mechanism and so the appropriate lock operation can be obtained by the relative rotation controlling mechanism. Also, the relative rotation of the housing member and the rotor member is appropriately restricted at the intermediate phase position and so the starting performance of the combustion engine can be improved when the supply and discharge controlling of the operation fluid is defective. Further, the combustion engine is actuated under the condition of the combustion engine fulfilling the minimal functions.

According to the variable valve timing system in which the operation fluid is adapted to be discharged from the advanced angle chamber, the retarded angle chamber and the relative rotation controlling mechanism by a single controlling valve provided in the hydraulic pressure circuit, the hydraulic pressure circuit can be simply and compactly configured.

Alternatively, when the operation fluid is adapted to be discharged from the advanced angle chamber, the retarded angle chamber and the relative rotation controlling mechanism by a plurality of controlling valves provided in the hydraulic pressure circuit, a conventional or known controlling valve (the controlling valve in which the operation fluid is set to be supplied to the advanced angle chamber or the retarded angle chamber when the controlling valve is de-energized) can be used as one of the plurality of controlling valves.

According to another aspect of the present invention, the variable valve timing system includes a housing member provided in a driving force transmitting system for transmitting a driving force from a crankshaft of a combustion engine to a camshaft for controlling the opening and closing of either one of an intake valve or an exhaust valve of the combustion engine, with housing member rotating as a unit with either one of the crankshaft or the camshaft, a rotor member rotatably assembled relative to the housing member and forming an advanced angle chamber and a retarded angle chamber in the housing member, with the rotor member rotating as a unit with either one of the camshaft or the crankshaft, and a relative rotation controlling mechanism allowing relative rotation of the housing member and the rotor member by an unlock operation through supply of an operation fluid, and restricting the relative rotation of the housing member and the rotor member at an intermediate angle phase between a most retarded angle phase and a most advanced angle phase by a lock operation through discharge of the operation fluid. A hydraulic pressure circuit controls the supply and discharge of the operation fluid to the relative rotation controlling mechanism and controls the supply and discharge of the operation fluid to the advanced angle chamber and the retarded angle chamber. The hydraulic pressure circuit includes an operation fluid source that supplies the operation fluid, a reservoir and a hydraulic pressure controlling valve having a first connecting port connected to the advanced angle chamber, and a second connecting port connected to the retarded angle chamber. The hydraulic pressure controlling valve communicates the first connecting port and the second connecting port to the reservoir when the combustion engine is started and/or when supply and discharge control of the operation fluid is defective.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
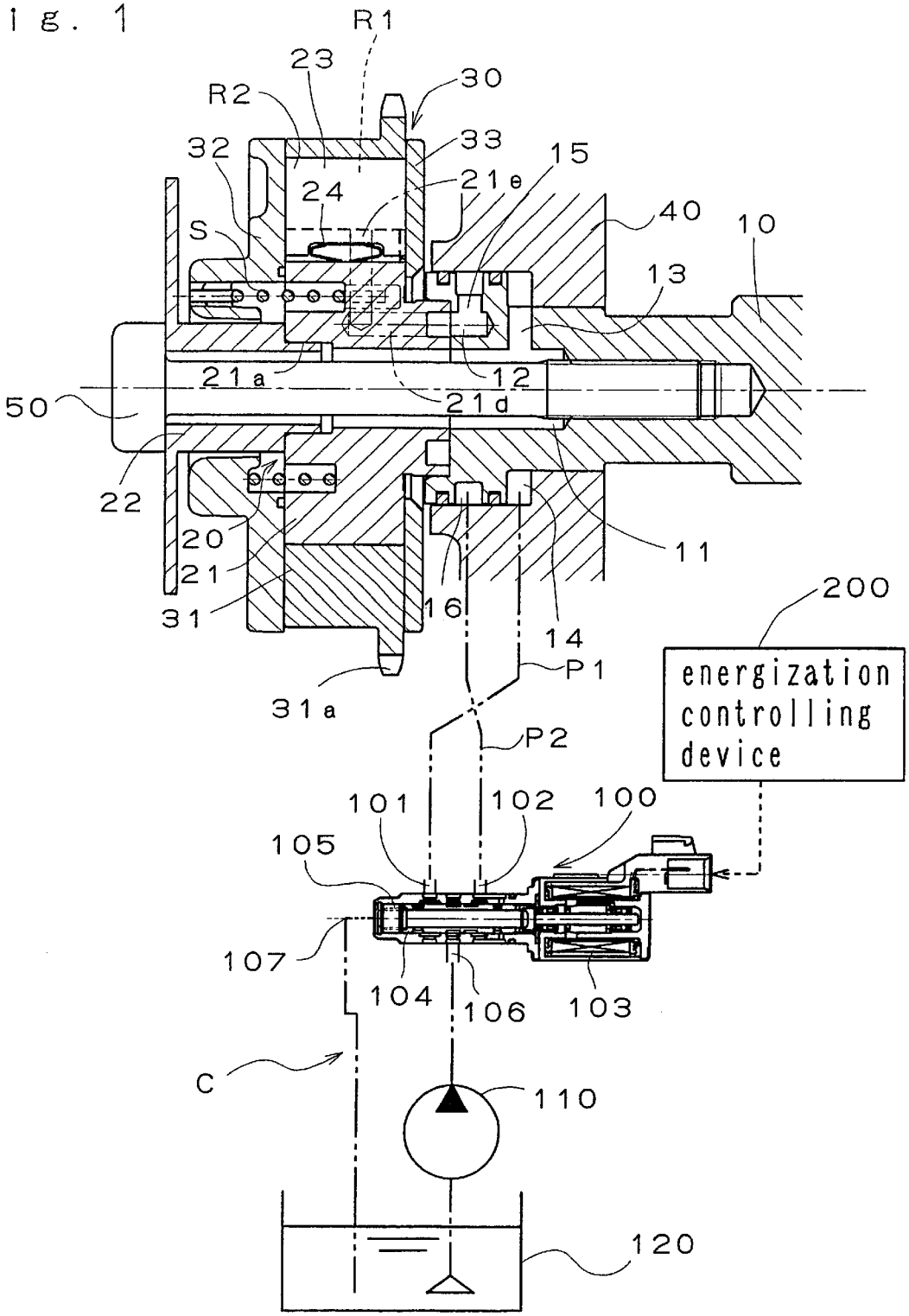
FIG. 1 is an illustration, partially in cross-section, of a variable valve timing system according to the present invention.

An embodiment of a variable valve timing system for an internal combustion engine in accordance with the preset invention is described below with reference to FIGS. 1–11. As generally illustrated in FIG. 1, the variable valve timing system includes a rotor member 20 assembled as one unit with a tip portion of a camshaft 10 and a housing member 30 supported by the rotor member 20 and rotatable within a predetermined range. The variable valve timing system also includes a torsion spring S disposed between the housing member 30 and the rotor member 20, and a relative rotation controlling mechanism B (shown in FIG. 2) for restricting relative rotation of the housing member 30 and the rotor member 20. The variable valve timing system further includes a hydraulic pressure circuit C for controlling the supply and discharge of operation fluid to the relative rotation controlling mechanism B as well as for controlling the supply and discharge of the operation fluid to an advanced angle chamber R1 and a retarded angle chamber R2.

The camshaft 10 has a known cam profile for controlling the opening and closing of an intake valve and is rotatably supported by the cylinder head 40 of the combustion engine. The camshaft 10 includes an advanced angle passage 11 and a retarded angle passage 12 extending in the axial direction of the camshaft 10. The advanced angle passage 11 is connected to a first connecting port 101 of a hydraulic pressure controlling valve 100 via a radially extending first passage 13, a first annular passage 14, and a first connecting passage P1. The retarded angle passage 12 is connected to a second connecting port 102 of the hydraulic pressure controlling valve 100 via a radially extending second passage 15, a second annular passage 16, and a second connecting passage P2. The radially directed first and second passages 13, 15 and the second annular passage 16 are formed in the cam shaft 10. The first annular passage 14 is formed in a stepped portion between the camshaft 10 and the cylinder head 40.

The rotor member 20 includes a main rotor 21 and a front rotor 22. The front rotor 22 has a cylindrical shape with a stepped portion assembled as one unit on the front (i.e., the left side of FIG. 1) of the main rotor 21. The rotor member 20 is engaged with the front end of the camshaft 10 as one unit by a bolt 50. The central inner bores of the main rotor 21 and the front rotor 22, whose front end is closed by the head portion of the bolt 50, communicate with the advanced angle passage 11 provided on the camshaft 10.

Figure 2:
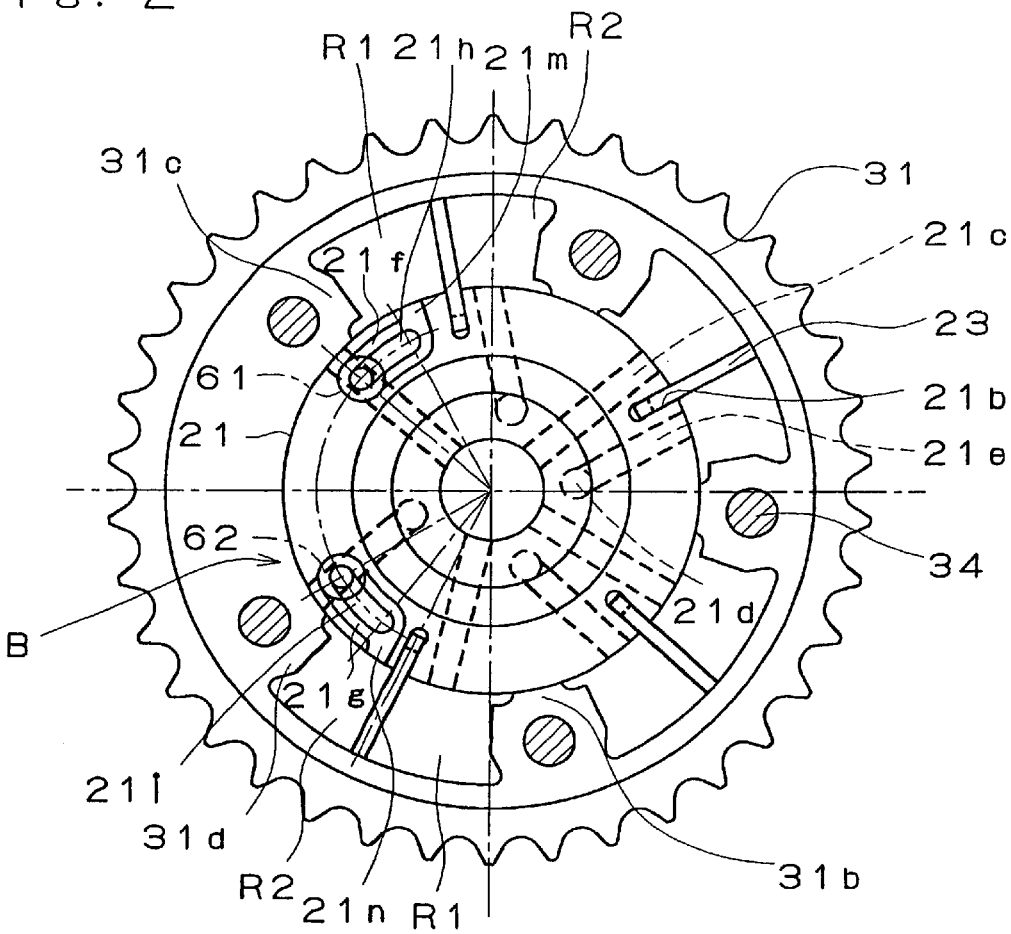
FIG. 2 is a cross-sectional view of a portion of the variable valve timing system shown in FIG. 1 as viewed from the front.

As shown in FIGS. 1 and 2, the main rotor 21 includes an inner bore 21*a* coaxially assembled with the front rotor 22 and four vane grooves 21*b* for receiving four vanes 23 respectively and a spring 24 biasing the vanes 23 in the radially outward direction. The respective vanes 23 assembled in the vane grooves 21*b* extend in the radially outward direction and thus form the advanced angle chambers R1 and the retarded angle chambers R2 respectively in the housing member 30. The main rotor 21 includes four radially extending third passages 21*c* in communication with the advanced angle passage 11 at the radial inner end via the central inner bores and in communication with the advanced angle chamber R1 at the radial outer end. The main rotor 21 also includes four axially extending passages 21*d* in communication with the retarded angle passage 12 and four radially extending fourth passages 21*e* in communication with the respective passages 21*d* at the radially inner end and in communication with the retarded angle chamber R2 at the radially outer end.

The housing member 30 includes a housing body 31, a front plate 32, a rear thin plate 33, and five bolts 34 (shown in FIG. 2) connecting together the parts of the housing member as one unit. The housing body 31 is provided with an integrally formed sprocket 31*a* on its outer periphery. The sprocket 31*a* is connected to the crankshaft of the combustion engine via a timing chain and is rotated in the clockwise direction of FIG. 2 by the driving force transmitted from the crankshaft.

The housing body 31 has four shoe portions 31*b* projecting in the radially inward direction and rotatably supports the main rotor 21 at the radially inner end of the respective shoe portions 31*b*. The opposing end faces of the front plate 32 and the rear thin plate 33 slidably contact the outer peripheral end faces of the main rotor 21 and the end faces of the respective vanes 23. The housing body 31 is also formed with a lug 31*c* defining the most retarded angle phase with the vanes 23, and a lug 31*d* restricting the most advanced angle phase with the vanes 23.

Figure 3:
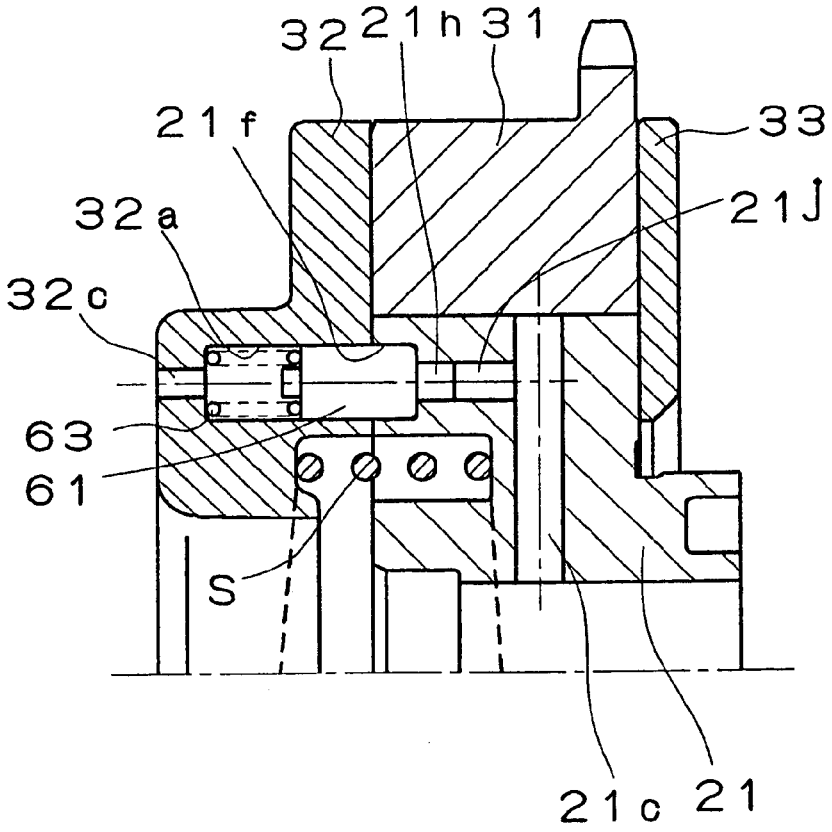
FIG. 3 is a cross-sectional view of an upper lock pin portion of the illustration in FIG. 2.
Figure 4:
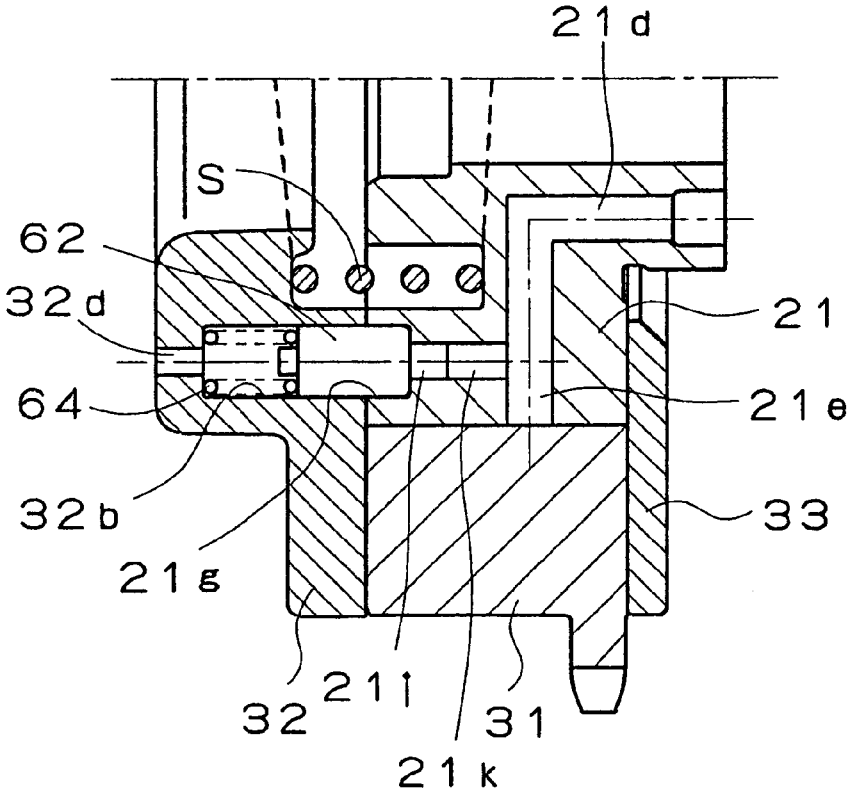
FIG. 4 is a cross-sectional view of a lower lock pin portion of the illustration in FIG. 2.

In the unlock operation of the relative rotation controlling mechanism B produced by the supply of operation fluid, the relative rotation of the housing member 30 and the rotor member 20 is allowed. In the lock operation of the relative rotation controlling mechanism B produced by the discharge of the operation fluid, the relative rotation of the housing member 30 and the rotor member 20 is restricted at the intermediate angle phase (the condition shown in FIG. 2) between the most retarded angle phase and the most advanced angle phase. As shown in FIGS. 2–4, the relative rotation controlling mechanism B is provided with a pair of lock pins 61, 62 and a pair of lock springs 63, 64.

Each lock pin 61, 62 is slidably movable in the axially outer direction within the axially extending retracting bores 32*a*, 32*b* provided in the front plate 32. Each lock pin 61, 62 is biased in the outward direction of the retracting bores 32*a*, 32*b* by the lock springs 63, 64 which are accommodated in the retracting bores 32*a*, 32*b*. Each retracting bore 32*a*, 32*b* is provided with an open bore portion 32*c*, 32*d* for smoothly moving the lock pins 61, 62 in the axial direction.

The tip portion of each lock pin 61, 62 can be detachably supported by circular lock grooves 21*f*, 21*g* formed in the main rotor 21 as shown in FIG. 4. By supplying operation fluid to the circular lock grooves 21*f*, 21*g*, the lock pins 61, 62 move in the axially outward direction by overcoming the biasing force (predetermined as a relatively small value) of the lock springs 63, 64, thus being moved or retracted to be accommodated in the retracting bores 32*a*, 32*b*. The tip portion of each lock pin 61, 62 is in contact with the end face of the main rotor 21, and slidably movable under the contact condition.

When the rotor member 20 is positioned at the intermediate angle phase relative to the housing member 30 as shown in FIG. 2, each end portion of the circular lock grooves 21*f*, 21*g* is positioned to oppose each corresponding retracting bore 32*a*, 32*b*. Each bottom portion of the circular lock grooves 21*f*, 21*g* is provided with circular connecting grooves 21*h*, 21*i* and bores 21*j*, 21*k* extending in the axial direction. As shown in FIGS. 2 and 3, the circular lock groove 21*f* is connected with the advanced angle passage 11 through the circular connecting groove 21*h*, the axial bore 21*j* and the radial bore 21*c*. The circular lock groove 21*f* is also connected with the advanced angle chamber R1 through a connecting groove 21*m* extending in radially outward direction.

As shown in FIGS. 2 and 4, the circular lock groove 21*g* is connected with the retarded angle passage 12 through the circular connecting groove 21*i*, the axial bore 21*k*, the radial bore 21*e*, and the axial bore 21*d*. The circular lock groove 21*g* is also connected with the retarded angle chamber R2 through a connecting groove 21*n* extending in the radially outward direction.

The torsion spring S disposed between the housing member 30 and the rotor member 20 rotates the rotor member 20 towards the advanced angle side relative to the housing member 30. The biasing force of the torsion spring S is predetermined to be of a value which cancels the biasing force (i.e., derived from the spring biasing the intake valve in the closing direction) for the camshaft 10 and the rotor member 20 rotating towards the retarded angle side. Thus, good response can be obtained when the relative rotation phase of the rotor member 20 relative to the housing member 30 is varied to the advanced angle side.

The hydraulic pressure controlling valve 100 shown in FIG. 1 is designed to provide the hydraulic pressure circuit C with an oil pump 110 actuated by the combustion engine and an oil reservoir 120 of the combustion engine. A spool 104 of the hydraulic pressure controlling valve 100 is moved in the left direction as viewed in FIG. 1 against the force of a spring 105 by the energization of a solenoid 103 in response to an output signal from an energization controlling device 200. By varying duty value, the spool 104 is operated shown as in FIGS. 5–11. The energization controlling device 200 controls the output (i.e., duty value) in accordance with the operating condition of the internal combustion by following a predetermined control pattern and based on the detected signal from sensors (i.e., sensors for detecting the crank angle, the cam angle, the throttle opening degree, the engine rpm, the temperature of the engine cooling water, and the vehicle speed).

Figure 5:
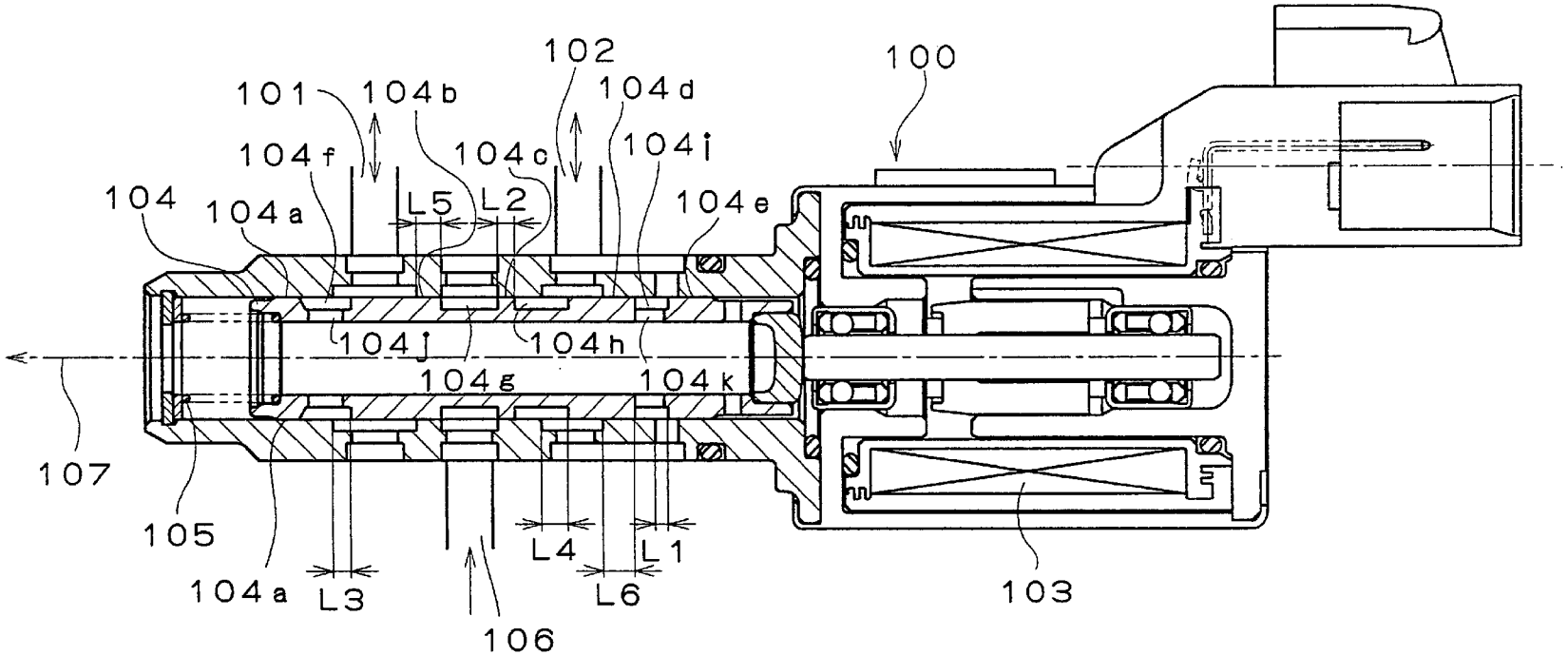
FIG. 5 is a enlarged cross-sectional view of the hydraulic pressure controlling valve shown in FIG. 1.

As shown in more detail in FIG. 5, the spool 104 is provided with five land portions 104*a*–104*e*, four annular grooves 104*f*–104*i* each formed between a pair of adjacent land portions, and a pair of connecting bores 104*j*, 104*k* connecting g the annular grooves 104*f*, 104*i* to a discharge port 107. The overlapping amount of the various portions described above as shown in FIG. 5 is set so that LI<L2<L3<L4<L5<L6.

When the spool 104 is under the condition shown in FIG. 5 (i.e., the de-energized condition of the duty value 0%), the communication between the supply port 106 connected to an outlet opening of the oil pump 110 and both connecting ports 101, 102 is prevented or locked by the land portions 104*b*, 104*c*. Both of the connecting ports 101, 102 are connected with the discharge port 107 connected to the oil reservoir 120 through the annular grooves 104*f*, 104*i* and the connecting bores 104*j*, 104*k*. The operation fluid can thus be discharged from both of the connecting ports 101, 102 to the discharge port 107. Accordingly, the operation fluid can be discharged from each advanced angle chamber R1, each retarded angle chamber R2, and both circular lock grooves 21*f*, 21*g* of the relative rotation controlling mechanism B to the oil reservoir 120.

Figure 6:
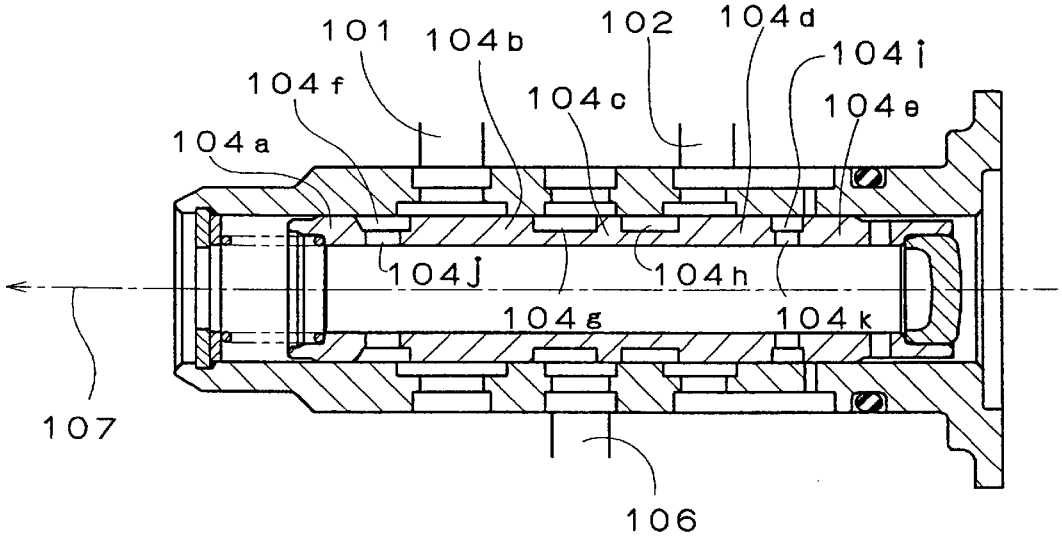
FIG. 6 is a cross-sectional view of the hydraulic pressure controlling valve shown in FIG. 5 under a first energization condition.

When the spool 104 is under the condition shown in FIG. 6, the communication between the supply port 106 and the connecting ports 101, 102 is locked or prevented by the land portions 104*b*, 104*c*. The communication between the first connecting port 101 and the discharge port 107 is established through the annular groove 104*f* and the connecting bore 104*j* and the operation fluid can be discharged from the connecting port 101 to the discharge port 107. The communication between the second connecting port 102 and the discharge port 107 is locked or prevented by the land portions 104*d*, 104*e*. Accordingly, the operation fluid can be discharged from each advanced angle chamber R1 and the circular lock groove 21*f* of the relative rotation controlling mechanism B through the hydraulic pressure controlling valve 100 to the oil reservoir 120. Also, the operation fluid can be locked or maintained in each retarded angle chamber R2 and the circular lock groove 21*g* of the relative rotation controlling mechanism B.

Figure 7:
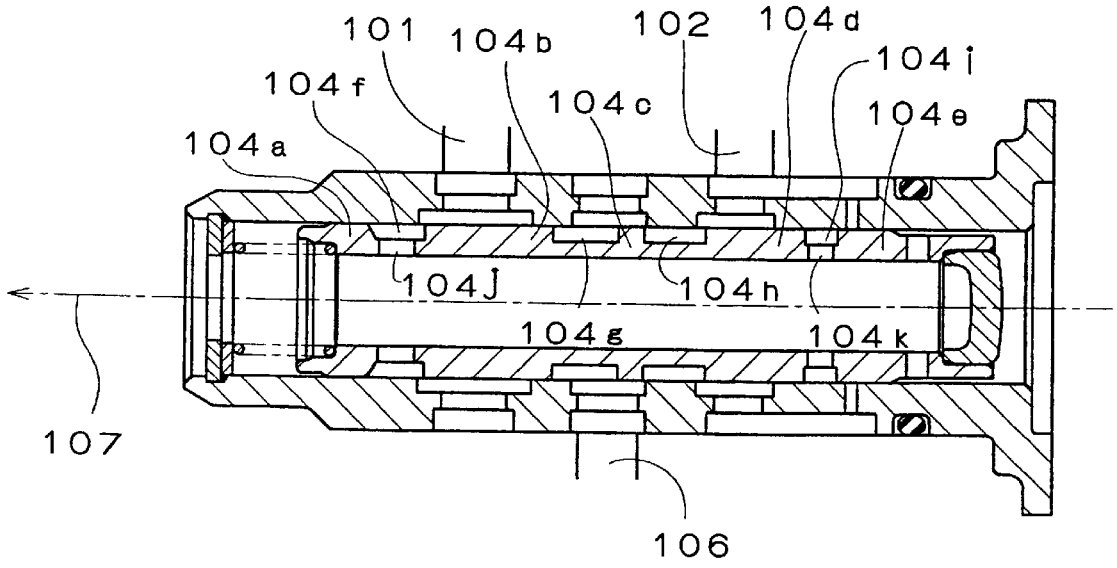
FIG. 7 is a cross-sectional view of the hydraulic pressure controlling valve shown in FIG. 5 under a second energization condition.

When the spool 104 is under the condition as shown in FIG. 7, the communication between the supply port 106 and the first connecting port 101 is locked by the land portion 104*b*. The communication between the supply port 106 and the second connecting port 102 is established through the annular groove 104*h*. The communication between the connecting port 101 and the discharge port 107 is established through the annular groove 104*f* and the connecting bore 104*j* and so the operation fluid can be supplied from the supply port 106 to the second connecting port 102. Then the operation fluid can be discharged from the connecting port 101 to the discharge port 107. Accordingly, the operation fluid can be supplied to the retarded angle chamber R2, and the circular lock grooves 21*g* of the relative rotation controlling mechanism B through the hydraulic pressure controlling valve 100. Further, the operation fluid can be discharged from each advanced angle chamber R1 and the circular lock groove 21*f* of the relative rotation controlling mechanism B to the oil reservoir 120 through the hydraulic pressure controlling valve 100.

Figure 8:
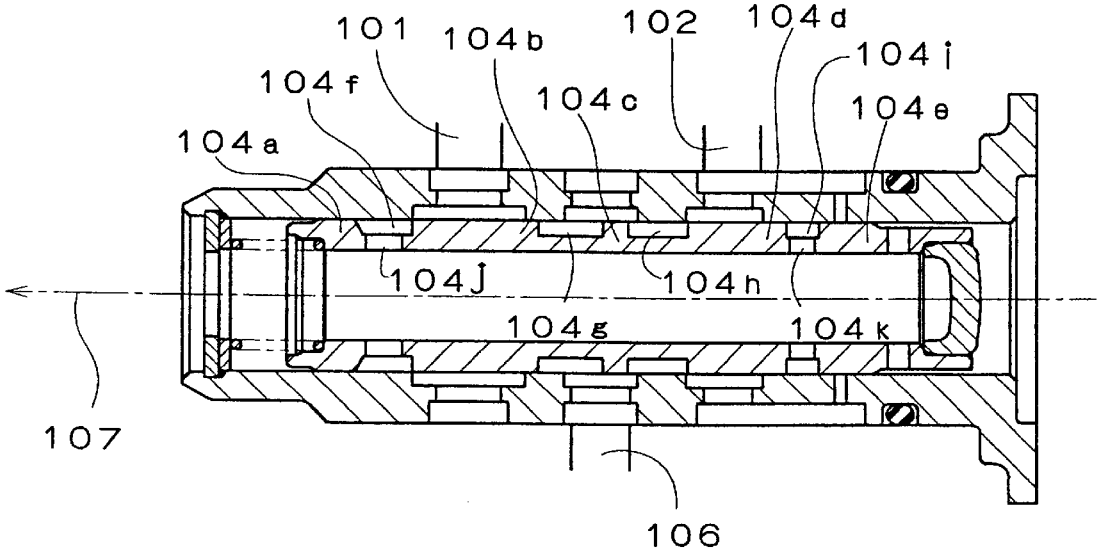
FIG. 8 is a cross sectional view of the hydraulic pressure controlling valve shown in FIG. 5 under a third energization condition.

When the spool 104 is under the condition as shown in FIG. 8, the communication between the supply port 106 and the first connecting port 101 is locked or prevented by the land portion 104*b*. The communication between the supply port 106 and the second connecting port 102 is established through the annular groove 104*h*. The communication between the connecting port 101 and the discharge port 107 is locked or prevented by the land portion 104*b*, and the operation fluid can be supplied from the supply port 106 to the second connecting port 102. Accordingly, the operation fluid can be supplied to the retarded angle chamber R2 and the circular lock groove 21*g* of the relative rotation controlling mechanism B through the hydraulic pressure controlling valve 100. Also, the operation fluid can be locked or maintained in each advanced angle chamber RI and the circular lock groove 21*f* of the relative rotation controlling mechanism B.

Figure 9:
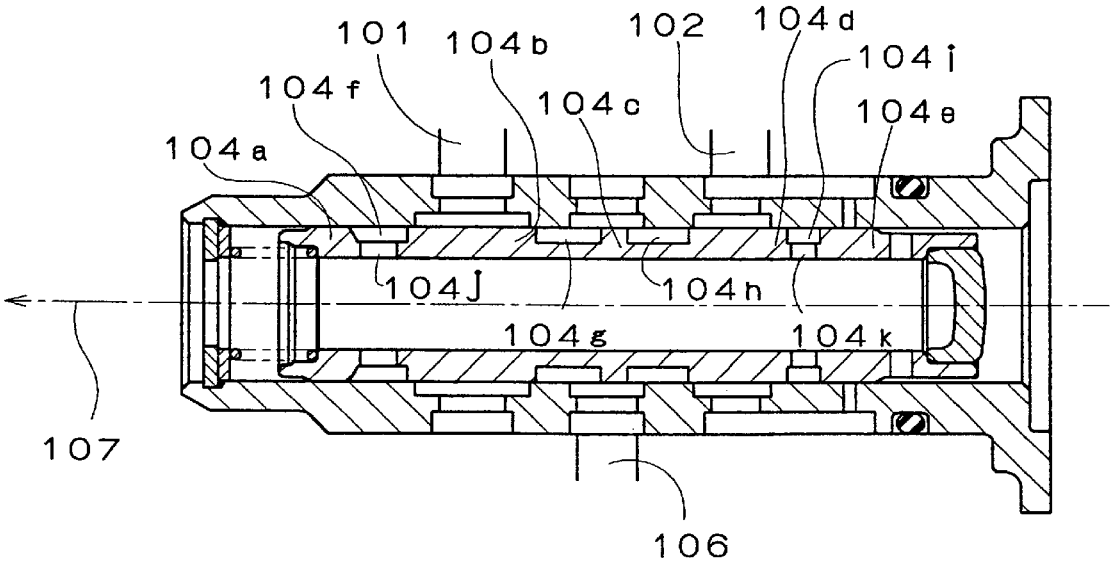
FIG. 9 is a cross sectional view of the hydraulic pressure controlling valve shown in FIG. 5 under a fourth energization condition.

When the spool 104 is under condition shown in FIG. 9, the communication between the supply port 106 and both connecting ports 101, 102 is locked or prevented by the land portions 104*b*, 104*d*. The communication between the discharge port 107 and both connecting ports 101, 102 is locked by he land portions 104*b*, 104*d*, and 104*e*. Accordingly, the operation fluid can be locked or maintained in each advanced angle chamber R1, each retarded angle chamber R2, and both of the circular lock grooves 21*f*, 21*g* of the relative rotation controlling mechanism B.

Figure 10:
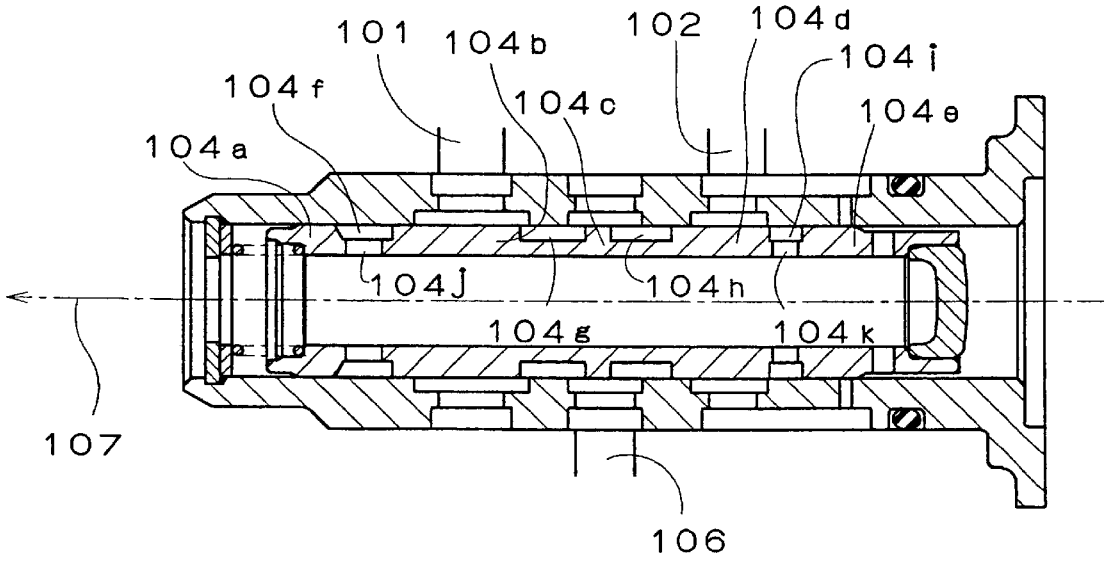
FIG. 10 is a cross sectional view of the hydraulic pressure controlling valve shown in FIG. 5 under a fifth energization condition.

When the spool 104 is under the condition shown in FIG. 10, the communication between the supply port 106 and the land portion 102 is locked by the land portion 104*d*. The communication between the supply port 106 and the connecting port 101 is established through the annular groove 104*g*. The communication between the connecting port 102 and the discharge port 107 is locked or prevented by both of the land portions 104*d*, 104*e*. The operation fluid can thus be supplied from the supply port 106 to the connecting port 101. Accordingly, the operation fluid can be supplied to each advanced angle chamber R1, and the circular lock groove 21*f* of the relative rotation controlling mechanism B through the hydraulic pressure controlling valve 100. Also, the operation fluid can be locked or maintained in each retarded angle chamber R2, and the circular lock groove 21*g* of the relative rotation controlling mechanism B.

Figure 11:
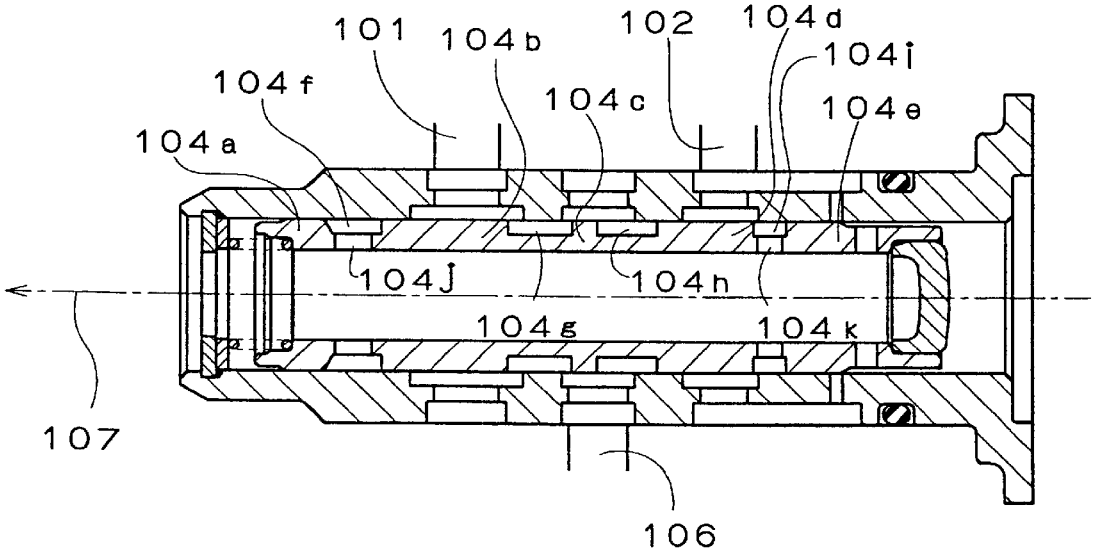
FIG. 11 is a cross sectional view of the hydraulic pressure controlling valve shown in FIG. 5 under a sixth energization condition.

When the spool 104 is under the condition shown in FIG. 11 (i.e., the condition of duty value 100%), the communication between the supply port 106 and the connecting port 102 is locked or prevented by the land portion 104*d*. The communication between the supply port 106 and the connecting port 101 is established through the annular groove 104*g*. The connecting port 102 is connected with the discharge port 107 through the annular groove 104*i* and the connecting bore 104*k*. The operation fluid can thus be supplied from the supply port 106 to the connecting port 101. Also, the operation fluid can be discharged from the connecting port 102 to the discharge port 107. Accordingly, the operation fluid can be supplied to each advanced angle chamber R1 and the circular lock groove 21*f* of the relative rotation controlling mechanism B through the hydraulic pressure controlling valve 100. Also, the operation fluid can be discharged from each retarded angle chamber R2, and the circular lock groove 21*g* of the relative rotation controlling mechanism B through the hydraulic pressure controlling valve 100.

According to the embodiment of the variable valve timing system of the present invention described above, when the combustion engine is actuated, the energization of the solenoid 103 of the hydraulic pressure controlling valve 100 is controlled by the energization controlling device 200. Accordingly, the relative rotation phase of the rotor member 20 relative to the housing member 30 can be adjusted and maintained at a desired phase within the range from the most retarded angle phase (i.e., the phase in which the volume of the advanced angle chamber R1 is minimum and the volume of the retarded angle chamber R2 is maximum) to the most advanced angle phase (i.e., the phase in which the volume of the advanced angle chamber R1 is maximum and the volume of the retarded angle chamber R2 is minimum). Thus, the valve timing of the intake valve during the drive of the combustion engine can be appropriately adjusted between the operation at the most retarded angle control condition and the most advanced angle control condition.

In this case, the relative rotation phase of the rotor member 20 relative to the housing member 30 to the advanced angle side is adjusted when the spool 104 is under the condition shown in FIG. 11. The operation fluid can be supplied to each advanced angle chamber R1 and the circular lock groove 21*f* of the relative rotation controlling mechanism B through the hydraulic pressure controlling valve 100. The operation fluid can be discharged from each retarded angle chamber R2 and the circular lock groove 21*g* of the relative rotation controlling mechanism B through the hydraulic pressure controlling valve 100.

In this case, the operation fluid can be supplied to the circular lock groove 21*f* of the relative rotation controlling mechanism B. The operation fluid can be supplied to each advanced angle chamber R1 when the lock pin 61 is unlocked against the lock spring 63 and is retracted and accommodated in the retracting bore 32*a*, or when the lock pin 61 is slidably engaged with the end face of the main rotor 21. The operation fluid can be discharged from each retarded angle chamber R2, when the lock pin 62 is slidably engaged with the end face of the main rotor 21, or when the lock pin 62 is slidably engaged with the circular lock groove 21*g*. Accordingly, the rotor member 20 rotates to the advanced angle side relative to the housing member 30.

The relative rotation phase of the rotor member 20 relative to the housing member 30 to the retarded angle side is adjusted when the spool 104 is under the condition shown in FIG. 7. The operation fluid can be supplied to each retarded angle chamber R2 and the circular lock groove 21*g* of the relative rotation controlling mechanism B through the hydraulic pressure controlling valve 100. The operation fluid can be discharged from each advanced angle chamber R1, and the circular lock groove 21*f* of the relative rotation controlling mechanism B through the hydraulic pressure controlling valve 100.

In this case, the operation fluid can be supplied to the circular lock groove 21*g* of the relative rotation controlling mechanism B. The operation fluid can be supplied to each retarded angle chamber R2 when the lock pin 62 is unlocked against the lock spring 64 and is retracted and accommodated in the retracting bore 32*b*, or when the lock pin 62 is slidably engaged with the end face of the main rotor 21. The operation fluid can be discharged from each advanced angle chamber R1 when the lock pin 61 is slidably engaged with the end face of the main rotor 21, or when the lock pin 61 is slidably engaged with the circular lock groove 21*f*. Accordingly, the rotor member 20 rotates to the retarded angle side relative to the housing member 30.

In the embodiment of the variable valve timing system of the present invention, when the combustion engine 4 is started, the energization of the solenoid 103 of the hydraulic pressure controlling valve 100 is controlled by the energization controlling device 200 following a predetermined controlling pattern. The hydraulic pressure controlling valve 100 is set to be operated at a predetermined time (slightly longer time than the time during which the crankshaft is cranked by a starter) with duty value of 0%. The operation fluid can be discharged from each advanced angle chamber R1, each retarded angle chamber R2, and both circular lock grooves 21*f*, 21*g* of the relative rotation controlling mechanism B to the oil reservoir 120 through the hydraulic pressure controlling valve 100.

Accordingly, when the combustion engine is started, the operation fluid remaining in each advanced angle chamber R1 and each retarded angle chamber R2 can be discharged. The relative rotation of the housing member 30 and the rotor member 20 is not interrupted by the operation fluid, and the rotor member 20 can be rotated quickly relative to the housing member 30 to the intermediate phase position between the most advanced angle phase position and the most retarded angle phase position by the torque variation of the driving force transmitting system. When the combustion engine is started, the operation fluid can be discharged from both circular lock grooves 21*f*, 21*g* of the relative rotation controlling mechanism B. The appropriate lock operation (the pushing force of each lock pin 61, 62 by each lock spring 63, 64) can be obtained by the relative rotation controlling mechanism B. The relative rotation of the housing member 30 and the rotor member 20 is appropriately restricted at the intermediate phase position. Accordingly, the starting performance of the combustion engine can he improved.

Further, in the present embodiment of the variable valve timing system of the present invention, when the supply and discharge controlling of the operation fluid is defective, the defect is detected by the defect detecting mode pre-installed in the energization controlling device 200. The energization of the hydraulic pressure controlling valve 100 to the solenoid 103 by the energization controlling device 200 is controlled following a predetermined control pattern upon the occurrence of a defect. The hydraulic pressure controlling valve 100 is set to be operated with the duty value of 0%. Accordingly, in this case, the operation fluid can be discharged from each advanced angle chamber RI, each retarded angle chamber R2 and both circular lock grooves 21*f*, 21*g* of the relative rotation controlling mechanism B to the oil reservoir 120 through the hydraulic pressure controlling valve 100. The same operation as that described above can thus be carried out. As a result, when the supply and discharge controlling defect of the operation fluid is generated, a good starting performance of the combustion engine can nevertheless be assured. Further, the combustion engine is actuated under the condition of the combustion engine fulfilling the minimal functions.

The defect detection by the defect detecting mode as described above can detect for instance, sensing defects associated with the breakage of wire of one or more sensors (i.e., the sensors for detecting the crank angle, the cam angle, the throttle opening degree, the engine rpm, the temperature of the engine cooling water, and the vehicle speed) and output a detecting signal to the energization controlling device 200. Control defects of the hydraulic pressure controlling valve 100 caused by a deficiency of the oil pressure, foreign material, and an energization defect to the hydraulic pressure controlling valve 100 caused by the breakage of wire can be also detected.

Figure 12:
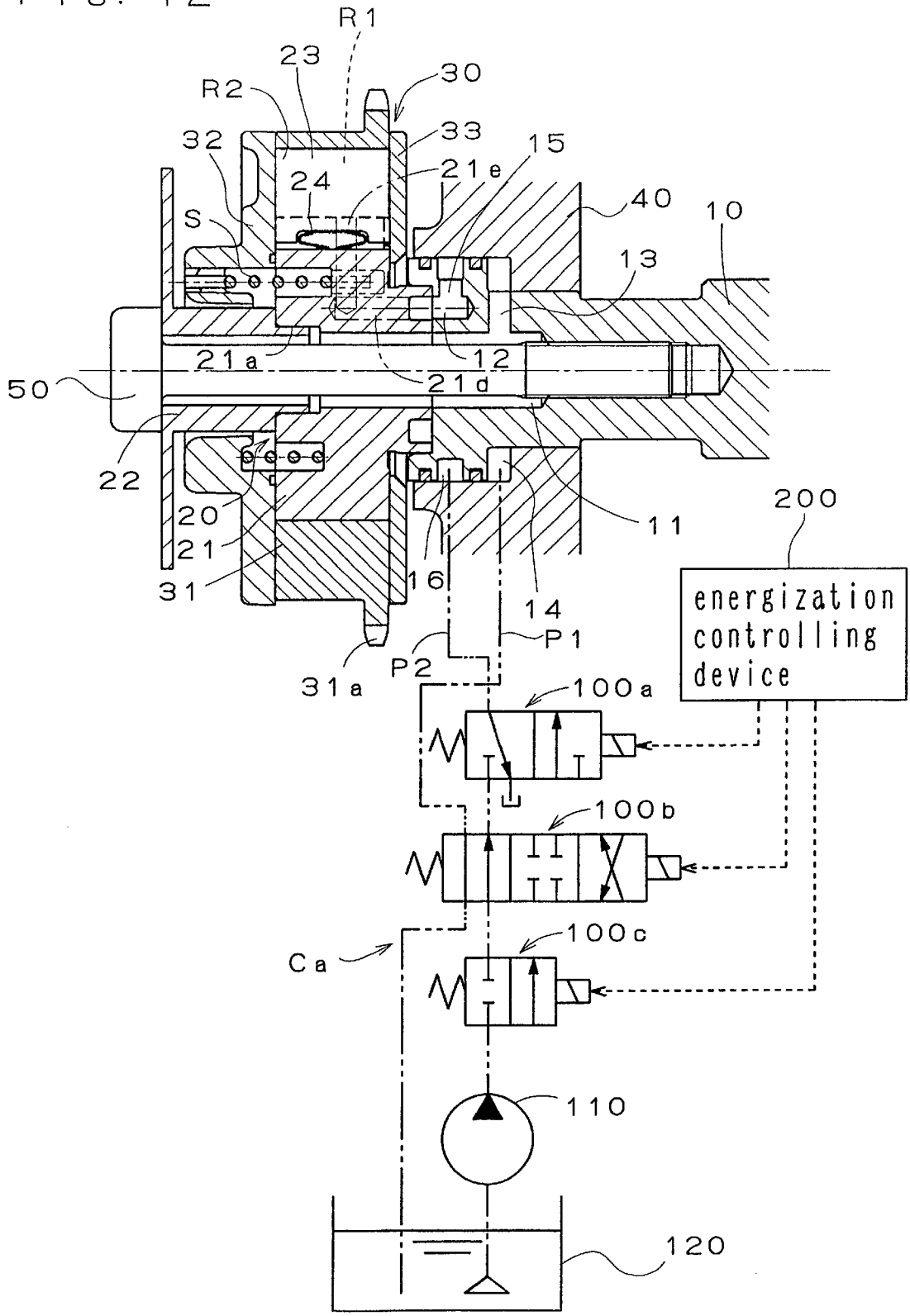
FIG. 12 is a schematic view of a variable valve timing system according to another embodiment of the present invention.

In the above described embodiment, in the hydraulic pressure circuit C providing one hydraulic pressure controlling valve 100, when the combustion engine is started and when the supply and discharge controlling of the operation fluid is defective, the operation fluid can be discharged from the advanced angle chambers R1, the retarded angle chambers R2 and the relative rotation controlling mechanism B. In addition, a hydraulic pressure circuit Ca providing three hydraulic pressure controlling valves 100*a,* 100*b,* and 100*c* as shown in FIG. 12, when the combustion engine is started and when the supply and discharge control of the operation fluid is defective, the operation fluid can also be discharged from the advanced angle chambers, the retarded angle chambers and the relative rotation controlling mechanism as well as the above described embodiment. When the combustion engine is started and when supply and discharge control of the operation fluid is defective, the hydraulic pressure controlling valves 100*a,* 100*c* are de-energized and positioned at the left side position in FIG. 12. In the other case, the hydraulic pressure controlling valves 100*a,* 100*c* are energized and positioned in the right side position in FIG. 12. Even without providing the hydraulic pressure controlling valve 100*c* in FIG. 12, the other embodiment of the variable valve timing system can be worked out.

According to the variable valve timing system of the present invention, the housing member 30 rotates as one unit with the crankshaft and the rotor member 20 rotates as one unit with the camshaft 10. However, the present invention can be used for another type of variable valve timing system in which the housing member rotates as one unit with the camshaft and the rotor member rotates as one unit with the crankshaft. The present invention can be also used in conjunction with a variable valve timing system in which the vane is formed as one unit with the rotor body.

Although the present invention is applied to the variable valve timing system equipped on the camshaft for controlling the opening and closing of the intake valve, the present invention can also be applied to another variable valve timing system equipped on the camshaft for controlling the opening and closing of the exhaust valve.

The principles, preferred embodiments and modes of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A variable valve timing system comprising:

a housing member provided in a driving force transmitting system for transmitting a driving force from a crankshaft of a combustion engine to a camshaft for controlling the opening and closing of either one of an intake valve or an exhaust valve of the combustion engine, said housing member rotating as a unit with either one of the crankshaft or the camshaft;

a rotor member relatively rotatably assembled with respect to the housing member and forming an advanced angle chamber and a retarded angle chamber at a vane portion in the housing member, said rotor member rotating as a unit with either one of the camshaft or the crankshaft;

a relative rotation controlling mechanism allowing relative rotation of the housing member and the rotor member by an unlock operation through supply of an operation fluid, and restricting the relative rotation of the housing member and the rotor member at an intermediate angle phase between a most retarded angle phase and a most advanced angle phase by a lock operation through discharge of the operation fluid;

a hydraulic pressure circuit for controlling the supply and discharge of the operation fluid to the relative rotation controlling mechanism as well as for controlling the supply and discharge of the operation fluid to the advanced angle chamber and the retarded angle chamber; and the hydraulic pressure circuit including an operation fluid source that supplies the operation fluid, a reservoir and a hydraulic pressure controlling valve having a first connecting port connected to the advanced angle chamber, and a second connecting port connected to the retarded angle chamber, the hydraulic pressure controlling valve communicating the first connecting port and the second connecting port to the reservoir when the combustion engine is started and/or when supply and discharge control of the operation fluid is defective.

2. The variable valve timing system according to claim 1, wherein the hydraulic pressure circuit is comprised of at least one control valve in addition to the hydraulic pressure controlling valve to discharge the operation fluid from the advanced angle chamber, the retarded angle chamber and the relative rotation controlling mechanism.

3. The variable valve timing system according to claim 1, wherein the hydraulic pressure controlling valve includes a movable spool having a plurality of lands that alternatively permit and prevent communication of the operation fluid source with first connecting port and the second connecting port based on a position of the spool.

4. A variable valve timing system comprising:

a housing member provided in a driving force transmitting system for transmitting a driving force from a crankshaft of a combustion engine to a camshaft for controlling the opening and closing of either one of an intake valve or an exhaust valve of the combustion engine, said housing member rotating as a unit with either one of the crankshaft or the camshaft;

a rotor member relatively rotatably assembled with respect to the housing member and forming an advanced angle chamber and a retarded angle chamber at a vane portion in the housing member, said rotor member rotating as a unit with either one of the camshaft or the crankshaft;

a relative rotation controlling mechanism allowing relative rotation of the housing member and the rotor member by an unlock operation through supply of an operation fluid, and restricting the relative rotation of the housing member and the rotor member at an intermediate angle phase between a most retarded angle phase and a most advanced angle phase by a lock operation through discharge of the operation fluid;

a hydraulic pressure circuit for controlling the supply and discharge of the operation fluid to the relative rotation controlling mechanism as well as for controlling the supply and discharge of the operation fluid to the advanced angle chamber and the retarded angle chamber; and the hydraulic pressure circuit being adapted to discharge the operation fluid from the advanced angle chamber, the retarded angle chamber and the relative rotation controlling mechanism when the combustion engine is started.

5. The variable valve timing system according to claim 4, wherein the hydraulic pressure circuit is comprised of a single controlling valve adapted to discharge the operation fluid from the advanced angle chamber, the retarded angle chamber and the relative rotation controlling mechanism.

6. The variable valve timing system according to claim 4, wherein the hydraulic pressure circuit is comprised of a plurality of control valves adapted to discharge the operation fluid from the advanced angle chamber, the retarded angle chamber and the relative rotation controlling mechanism.

7. A variable valve timing system comprising:

a housing member provided in a driving force transmitting system for transmitting a driving force from a crankshaft of the combustion engine to a camshaft for controlling opening and closing of either one of an intake valve or an exhaust valve of the combustion engine, said housing member rotating as a unit with either one of the crankshaft or the camshaft;

a rotor member rotatably assembled relative to the housing member and forming an advanced angle chamber and a retarded angle chamber at a vane portion in the housing member, said rotor member rotating as a unit with either one of the camshaft or the crankshaft;

a relative rotation controlling mechanism allowing relative rotation of the housing member and the rotor member by an unlock operation through supply of an operation fluid, and restricting the relative rotation of the housing member and the rotor member at an intermediate angle phase between a most retarded angle phase and a most advanced angle phase by a lock operation through discharge of the operation fluid;

a hydraulic pressure circuit for controlling the supply and discharge of the operation fluid to the relative rotation controlling mechanism and for controlling the supply and discharge of the operation fluid to the advanced angle chamber and the retarded angle chamber; and the hydraulic pressure circuit being adapted to discharge the operation fluid from the advanced angle chamber, the retarded angle chamber and the relative rotation controlling mechanism when supply and discharge control of the operation fluid is defective.

8. The variable valve timing system according to claim 7, wherein the hydraulic pressure circuit is comprised of a single controlling valve adapted to discharge the operation fluid from the advanced angle chamber, the retarded angle chamber and the relative rotation controlling mechanism.

9. The variable valve timing system according to claim 7, wherein the hydraulic pressure circuit is comprised of a plurality of control valves adapted to discharge the operation fluid from the advanced angle chamber, the retarded angle chamber and the relative rotation controlling mechanism.

* * * * *